US007311615B2

(12) United States Patent
Hsu

(10) Patent No.: US 7,311,615 B2
(45) Date of Patent: Dec. 25, 2007

(54) GOLF CLUB HEAD WITH CERAMIC LAYER

(76) Inventor: Charles Hsu, No. 12, Lane 822, Kau Shi Road, Yangmei Cheng, Taoyuan (TW) 326

( * ) Notice: Subject to any disclaimer, the term of this patent is extended or adjusted under 35 U.S.C. 154(b) by 180 days.

(21) Appl. No.: 11/171,412

(22) Filed: Jul. 1, 2005

(65) Prior Publication Data

US 2007/0004535 A1 Jan. 4, 2007

(51) Int. Cl.
*A63B 53/04* (2006.01)

(52) U.S. Cl. ..... 473/345; 473/330

(58) Field of Classification Search ..... 473/324, 473/342, 345, 349, 409, 330; 427/181, 182, 427/205, 473, 474
See application file for complete search history.

(56) References Cited

U.S. PATENT DOCUMENTS 1,582,836 A * 4/1926 Link ..... 473/346
3,989,606 A * 11/1976 Kampert ..... 205/83
4,196,061 A * 4/1980 Satee ..... 205/180
4,951,953 A * 8/1990 Kim ..... 473/320
5,188,643 A * 2/1993 Iacovangelo ..... 51/293
5,207,427 A * 5/1993 Saeki ..... 473/343
5,403,460 A * 4/1995 Sala et al. ..... 204/252
5,472,202 A * 12/1995 Yamanaka ..... 473/349
5,509,659 A * 4/1996 Igarashi ..... 473/345
5,538,246 A * 7/1996 Dekura ..... 473/311
5,578,187 A * 11/1996 Zitko et al. ..... 205/191
5,603,667 A * 2/1997 Ezaki et al. ..... 473/324
5,839,975 A * 11/1998 Lundberg ..... 473/346
5,851,158 A * 12/1998 Winrow et al. ..... 473/330
6,443,854 B1 * 9/2002 Calboreanu ..... 473/324
6,638,182 B2 * 10/2003 Kosmatka ..... 473/331
7,063,628 B2 * 6/2006 Reyes et al. ..... 473/324
7,087,268 B2 * 8/2006 Byrne et al. ..... 427/305
7,097,573 B2 * 8/2006 Erickson et al. ..... 473/345
7,214,143 B2 * 5/2007 Deshmukh ..... 473/342
2005/0137029 A1 * 6/2005 Evans et al. ..... 473/342
2006/0142093 A1 * 6/2006 Moriyama ..... 473/292
2006/0211514 A1 * 9/2006 Deshmukh ..... 473/342

OTHER PUBLICATIONS

Golfers/ Warehouse, Cleveland-CG10 Black Peral Wedge, http://www.nevadabobs.com/golferswh/product.asp?s_id=0&dept_id=110&pf_id=CLV_CG10_BLK_WDG&, 2005.*
Formation of Metal Matrix Composite Layer on Aluminum Alloy with Ti-Cu Powder by Laser, http://www.sciencedirect.com/science?_ob=ArticleURL&_udi=B6TVV-43WTXCV-3F&_user=2502287&_coverDate=07%2F31%F2001&_rdoc=1&_fmt=&_orig=search&_sort=d&view=c&_acct=C000055109&_version=1&_urlVersion=0&_userid=2502287&md5=f1cc04687a4e95dba694af9e17ff5825, Jul. 2001.*

* cited by examiner

*Primary Examiner*—William M. Pierce
(74) *Attorney, Agent, or Firm*—Troxell Law Office, PLLC

(57) ABSTRACT

A hollow club head having an aluminum alloy base material covered with another material layer of Ni or Ni/P with ceramic granules. The thickness of the material layer on the striking face is thicker than on the rest of the club head. The material layer has a hardness between Hv500 ad Hv850 or greater than Hv1500 and an average granule diameter smaller than 10 microns.

15 Claims, 7 Drawing Sheets

GOLF CLUB HEAD WITH CERAMIC LAYER

FIELD OF THE INVENTION

The present invention relates to a golf club; more particularly, relates to providing a club head having better endurance and practicality with big size and volume, big areas of strike plate and sweet spot, high coefficient of restitution and coefficient of energy transformation, good hardness and wear resistance, and big friction resistance at the strike plate to avoid side spinning and back spinning.

DESCRIPTION OF THE RELATED ARTS

Modern golf clubs include woods, iron woods, irons and putters. The woods are also called metal woods made of steel, titanium or glass fiber, etc.

A common refinement of metal wood is to obtain a metal wood of titanium alloy with light weight but high strength because a modern metal wood is usually made of titanium alloy.

The size of a metal wood used as a first tee shot is usually measured by its volume. The volume of the club head of the metal wood for the first tee shot is greater than 30 cc (cubic centimeter). Although in the regulations of the United States Golf Association, the biggest volume for a club head used in games is 460 cc; yet, for a club head not used in games, its volume may even as big as 600 cc because a club head with big size and big volume contains big sweet spot and high inertia with bigger strike-miss tolerance.

Generally, a club head with big size and big volume is thinner in the crown section and the bottom section yet thicker in the heel section and the toe section while having the center of gravity properly adjusted. When striking a ball by a gulf club having this kind of club head, even the striking is not at the center of the strike plate, the flying of the ball will not twist; the spinning of the ball is reduced; the coefficient of restitution of the ball is increased; and the flying distance is increased as well.

Yet, a modern club head of titanium alloy has the following disadvantages: (1) The titanium is expensive and must be melted, cast and welded in a vacuum environment. (2) The manufacturing machine and the manufacturing cost are expensive. (3) For manufacturing a hollowed club head with big size, its wall width must be reduced, which may obtain a club head with uneven wall width and other defects and may require complex procedures together with a lot of human resource, material, and time to mend those problems and defects.

In the other hand, a club head of aluminum alloy has a density of 2.7 g/cc (gram per cubic centimeter), while a club head of titanium alloy has a density of 4.5 g/cc. It is clear that the density of aluminum alloy is only 60 percents to that of titanium alloy. In order to obtain the flexibility for striking, the weight of the club head must be controlled in a limited range. A heavier club head has a greater inertia and the ball can fly farer after striking. Owing to the lower density of aluminum alloy, under the same weight, the club head can obtain a bigger volume; in another word, a club head can be made of aluminum alloy to obtain a bigger size and volume to increase the sweet spot at the strike plate. And, a club head of aluminum alloy can be made by forging, atmospheric die-casting, vacuum casting or gravity casting, which has the advantage of a relatively lower cost. In order to increase the hardness of the club head of aluminum alloy, it is usually processed with a T6 precipitate hardening process or a surface-hardening anode process so that it will not be over-deformed after striking and waste some striking energy But, the strike plate on the club head of aluminum alloy processed with precipitate hardening and surface-hardening anode process is still not hard enough; the hard layer is not thick enough; and, the durability of the club head is not good enough, etc. So, the prior arts do not fulfill users' requests on actual use.

SUMMARY OF THE INVENTION

Therefore, the main purpose of the present invention is to obtain a club head with big size and volume together with big areas of strike plate and sweet spot, which has high coefficient of restitution and coefficient of energy transformation, good hardness and wear resistance, and big friction resistance at the strike plate to avoid side spinning and back spinning that better endurance and practicality are achieved while the ball fly farer and its flight trajectory is stabler.

To achieve the above purpose, the present invention is a golf club head with a ceramic layer; the club head has a strike plate for striking and comprises a hosel to integrate with a shaft; the club head is made of a base material covered with a hard material layer having higher hardness; the base material is an aluminum alloy and the hard material layer is made of a compound material of Ni with hard ceramic granules or NI/P with hard ceramic granules; and, the hard material layer at the strike plate is thicker than the other parts. Accordingly, a novel golf club head with a ceramic layer is obtained.

BRIEF DESCRIPTION OF THE DRAWINGS

The present invention will be better understood from the following detailed descriptions of the preferred embodiments according to the present invention, taken in conjunction with the accompanying drawings, in which.

DESCRIPTION OF THE PREFERRED EMBODIMENT

The following descriptions of the preferred embodiments are provided to understand the features and the structures of the present invention.

Figure 1:
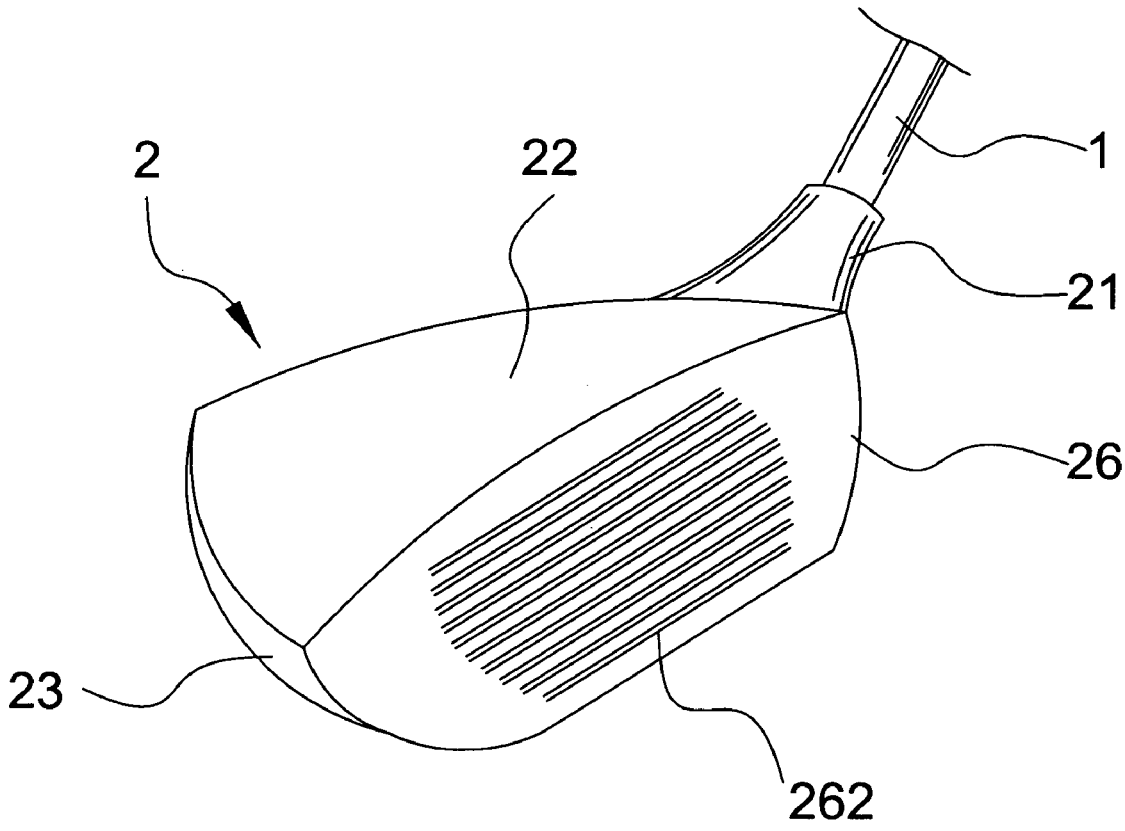
FIG. 1 is a perspective view of a preferred embodiment according to the present invention.
Figure 2:
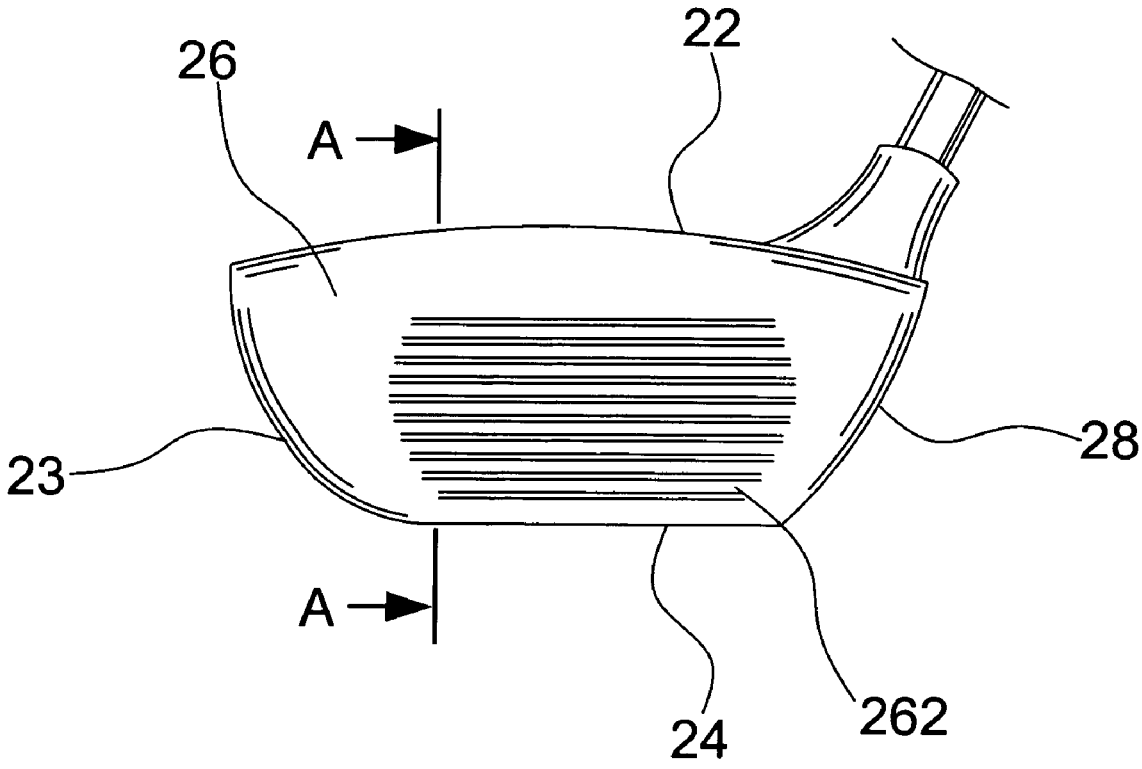
FIG. 2 is a front view of the preferred embodiment according to the present invention.
Figure 3:
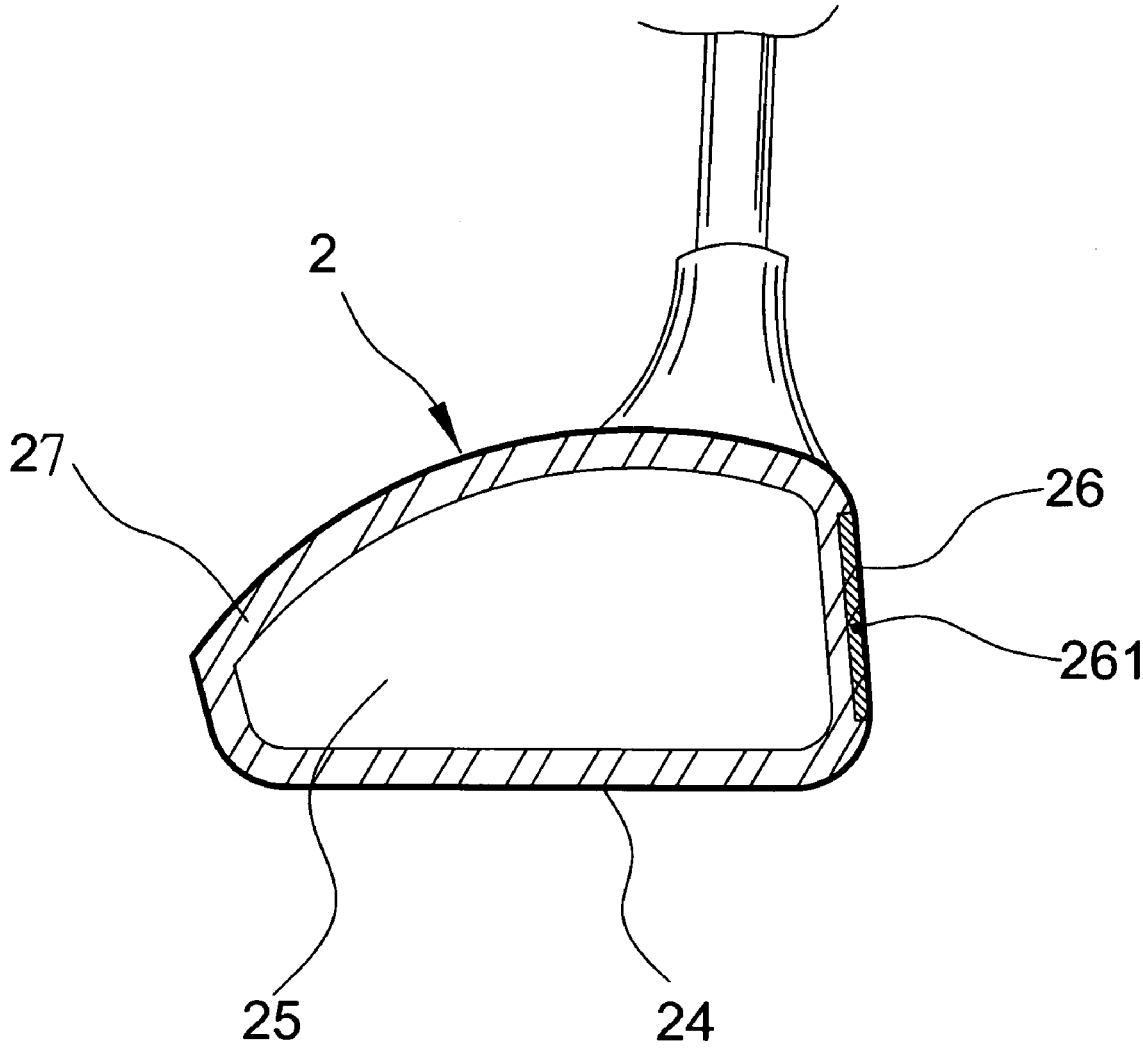
FIG. 3 is an A-A cross-sectional view of FIG. 2 according to the preferred embodiment of the present invention.

Please refer to FIG. 1 through FIG. 3, which are a perspective view, a front view, and an A-A cross-sectional view of FIG. 1, according to a preferred embodiment of the present invention. As shown in the figures, the present invention is a golf club head with a ceramic layer, whose golf club comprises a shaft 1 and a club head 2. The club head 2 comprises a hosel 21, a crown section 22, a toe section 23, a bottom section 24, a hollow interior 25 and a strike plate 26. The club head 2 is made of a base material covered with a hard material layer 27. The base material is an aluminum alloy; the hard material layer 27 is made of a compound material of Ni with hard ceramic granules or Ni/P with hard ceramic granules; and, the strike plate 26 has a thicker hard material layer 261.

Therein, the base material of the club head 2 is an aluminum alloy, especially which can be processed with a T6 precipitate hardening process. The aluminum alloy is obtained through forging, atmospheric die-casting, vacuum casting or gravity casting. The shape of the base material of the club is obtained through lathing, milling or grinding; and, afterward, the base material is processed with an manufacturing process—a typical electroplating process for aluminum alloy, including degreasing, micro-etching, acid washing, zinc metathesis and electroplating.

And, the hard material layer 27,261 is made of Ni with hard ceramic granules or Ni/P with hard ceramic granules, which is obtained through precipitating Ni and/or P together with hard ceramic granules on the surface of the aluminum-alloy-based material under proper conditions. The hard material layer 27,261 obtained has a soft part and a hard part, where the soft part is Ni and the hard part is Ni—P together with hard ceramic granules.

The hard ceramic granule, such as silicon carbide, boron nitride, tungsten carbide, aluminum oxide, titanium diboride and zirconium borites, has a hardness greater than Hv1500 and has an average granule diameter smaller than 10 micron (μm). The hard material layer obtained has a hardness of Hv500 (Vickers hardness) to Hv800, more preferably Hv600 to Hv750; and, after being further processed with a thermal treatment, the surface of the hard material layer has a hardness of Hv500 to Hv1000, more preferably Hv700 to Hv900.

The thickness of the hard material layer 27,261 can be changed according to various applications. The thickness of the hard material layer 261 at the strike plate 26 is thicker than that of the hard material layer 27 at the other parts of the club head to obtain higher coefficient of restitution. So, the hardness and the thickness at the strike plate is in creased with a thickness of the hard material layer 261 at the strike plate as 30 μm to 500 μm, more preferably, 50 μm to 250 μm, while a thickness at the other parts is 100 μm to 100 μm, more preferably, 20 μm to 30 μm. Various thicknesses at various parts of the hard material layer 27,261 are obtained through changing a node shape, and/or shielding, covering and pasting. Hence, a novel golf club head with a ceramic layer is obtained.

Figure 4:
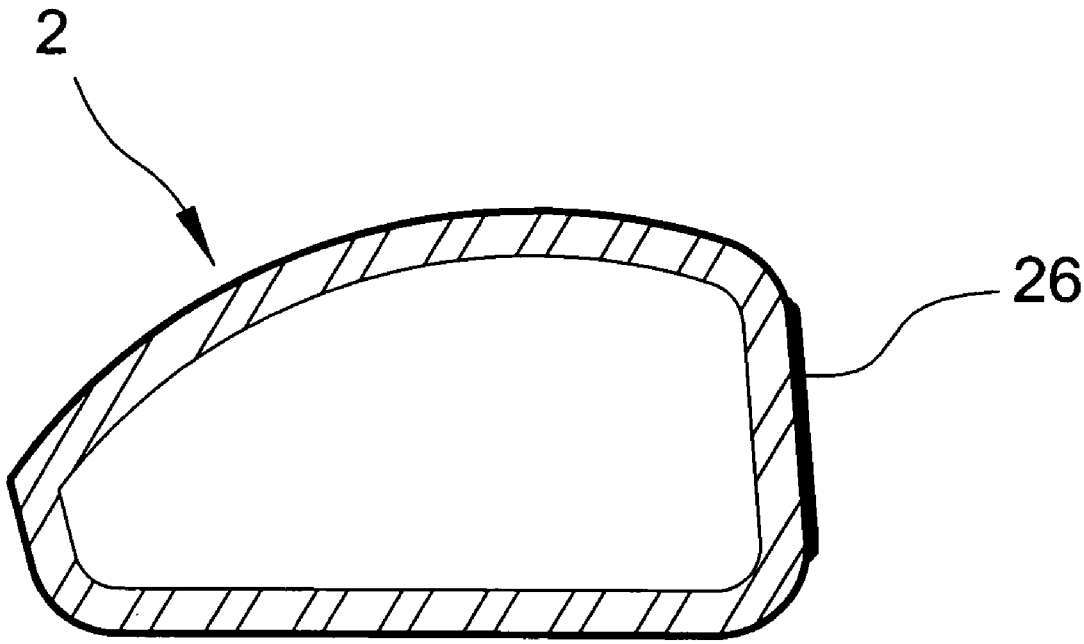
FIG. 4 is a view showing a hard material layer at a strike plate of the preferred embodiment according to the present invention.

Please refer to FIG. 4, which is a view showing the hard material layer at the strike plate of the preferred embodiment according to the present invention. As shown in the figure, in order to increase the coefficient of restitution at the strike plate, scorelines 262 (in FIG. 2) at the strike plate 26 can be made before being processed with electroplating. In order to increase the stability in the flight trajectory of the gulf ball after striking, the area of the strike plate 24 and the size and the volume of the club head 2 are usually increased with the center of gravity properly adjusted to prevent back spinning.

Owing to the limitation over the weight of the club head 2 on designing, which is 200 g (gram) to 300 g, a metal wood is hollowed to increase the area of the sweet spot and the stability of the gulf ball after striking. Because the aluminum alloy has a density lower than that of a traditional titanium alloy, a hollow shape can obtain bigger size and volume while distributing more weight of the club head 2 to the toe section 23 and the heel section 28 (in FIG. 2). Hence, a secure hardness for striking can be obtained with the thick plane section; and, so, the sweet spot is increased in area and a better stability in the flight trajectory of the gulf ball is obtained as well.

Figure 5:
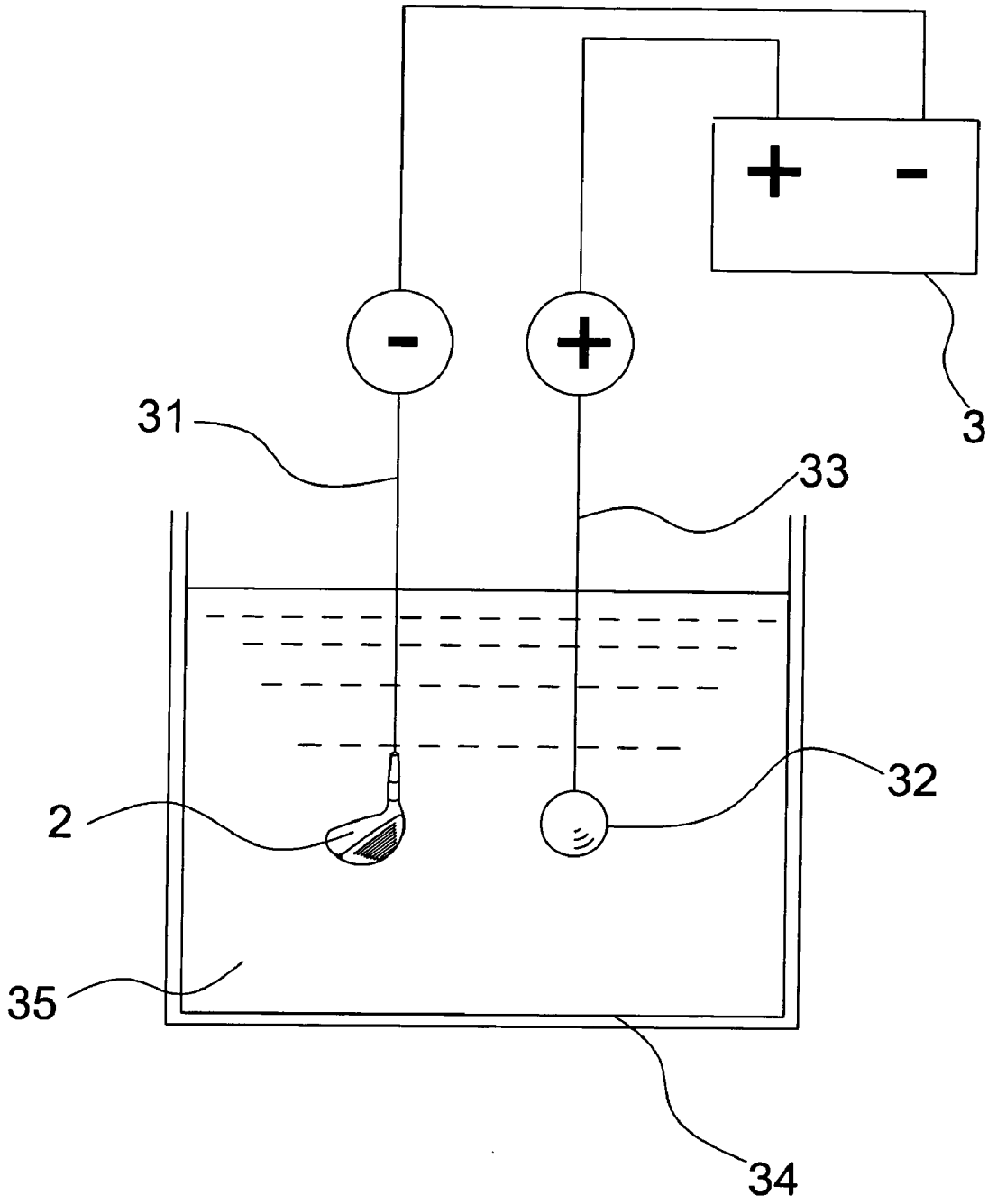
FIG. 5 is a view showing a status of electroplating according to the preferred embodiment of the present invention.
Figure 6:
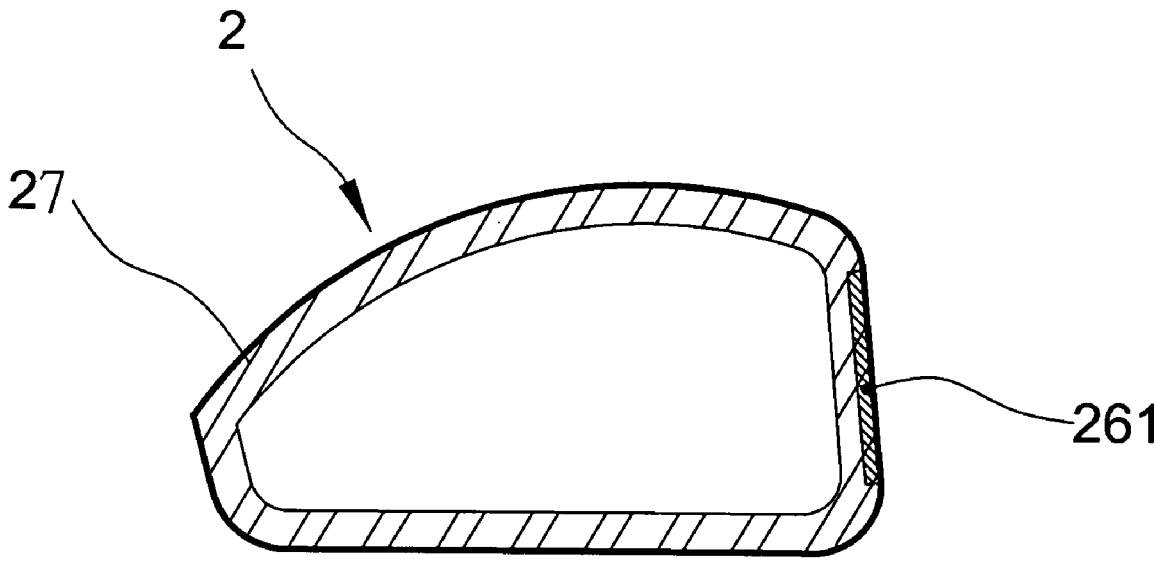
FIG. 6 is a view showing a rugged surface of the hard material layer at the strike plate according to the preferred embodiment of the present invention.

Please refer to FIG. 5 and FIG. 6, which are views showing a status of electroplating and showing a rugged surface of the hard material layer at the strike plate according to the preferred embodiment of the present invention. As shown in the figures, when electroplating, the club head 2 is connected to a cathode 31 of a power supplier 3; a soluble nickel anode 32, such as a nickel ball, a nickel slice, a nickel plate or a nickel strip, is connected to an anode 33 of the power supplier 3; and, an nickel sulphate or nickel sulphamate is obtained as an electroplating liquid 35 in an electroplating trough 34, where the electroplating liquid 35 is added with hard ceramic granules. After properly adjusting the components of the electroplating liquid 35 and the time and the current for the electroplating, a hard material layer 27 is obtained in the end with a consistency of phosphorus in 0.5 wt % to 10 wt %, more preferably 0.6 wt % to 3 wt % and with a consistency of hard ceramic granule in 1 wt % to 10 wt %, more preferably 2 wt % to 4 wt %. And, by properly adjusting the conditions for electroplating, a more rugged surface of the hard material layer 261 is obtained so that the friction resistance is increased and the side spinning and the back spinning can be avoided on striking.

Figure 7:
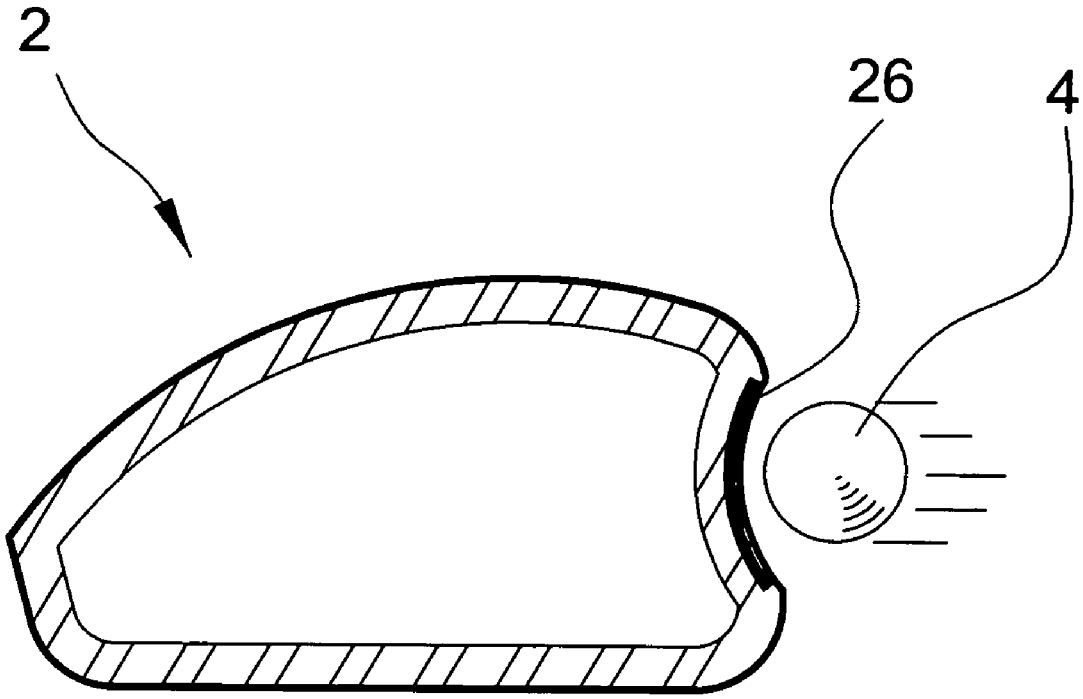
FIG. 7 is a view showing a status of use of the preferred embodiment according to the present invention.

Please refer to FIG. 7, which a view showing a status of use of the preferred embodiment according to the present invention. As shown in the figure, when striking a gulf ball 4 with a gulf club having the club head 2 according to the present invention, the strike plate 26 is slightly concaved; yet, owing to the high hardness on the surface layer of the strike plate 26, a strong rebound is obtain with the high coefficient of restitution. And, owing to the strong rebound caused by the slight concave of the strike plate 26, the gulf ball 4 can fly a farer distance; in addition, for the friction resistance is increased, the side spinning and the back spinning of the gulf ball 4 after being struck out are reduced to stabilize the flight trajectory of the ball.

To sum up, the present invention is a golf club head with a ceramic layer, which has advantages of a bigger golf club head in size and volume, bigger areas of a strike plate and a sweet spot, high coefficient of restitution and high coefficient of energy transformation; and which obtains better endurance and practicality with hard material layer of good hardness and good wear resistance and with the strike plate having good friction resistance to avoid side spinning and back spinning for a more stable flight trajectory.

The preferred embodiments herein disclosed are not intended to unnecessarily limit the scope of the invention. Therefore, simple modifications or variations belonging to the equivalent of the scope of the claims and the instructions disclosed herein for a patent are all within the scope of the present invention.

What is claimed is:

1. A golf club head assembly comprising:

a) a shaft; and b) a club head having:

I) a hosel connected to the shaft;

ii) a crown section;

iii) a toe section;

iv) a bottom section;

v) a hollow interior; and vi) a strike plate having a strike plate portion, wherein the club head is made of a base material and a material layer coating the base material, the base material is an aluminum alloy, the material layer is selected from a group consisting of Ni with ceramic granules and Ni/P with ceramic granules, wherein the material layer has a first thickness located on the strike plate portion of the strike plate, and a second thickness located on non-strike plate portions of the club head, the first thickness of the hard material layer is thicker than the second thickness of the hard material layer.

2. The golf club head assembly according to claim 1, wherein the material layer has a hardness greater than Hv 1500 (Vickers hardness) and an average granule diameter smaller than 10 μm (micron).

3. The golf club head assembly according to claim 1, wherein the ceramic granules are selected from a group consisting of silicon carbide, boron nitride, tungsten carbide, aluminum oxide, titanium diborite, and zirconium borites.

4. The golf club head assembly according to claim 1, wherein the material layer has a hardness greater between Hv500 and Hv850.

5. The golf club head assembly according to claim 1, wherein the material layer has a hardness greater between Hv600 and Hv750.

6. The golf club head assembly according to claim 1, wherein the first thickness located on the strike plate portion of the strike plate is between 30 μm and 500 μm.

7. The golf club head assembly according to claim 1, wherein the first thickness located on the strike plate portion of the strike plate is between 50 μm and 250 μm.

8. The golf club head assembly according to claim 1, wherein the second thickness located on the non-strike plate portions of the club head is between 10 μm and 100 μm.

9. The golf club head assembly according to claim 1, wherein the second thickness located on the non-strike plate portions of the club head is between 20 μm and 30 μm.

10. The golf club head assembly according to claim 1, wherein the material layer consists of phosphorous in a range between 0.5 wt % and 10 wt %.

11. The golf club head assembly according to claim 1, wherein the material layer consists of phosphorous in a range between 0.6 wt % and 3 wt %.

12. The golf club head assembly according to claim 1, wherein the material layer consists of ceramic granules in a range between 1 wt % and 10 wt %.

13. The golf club head assembly according to claim 1, wherein the material layer consists of ceramic granules in a range between 2 wt % and 4 wt %.

14. The golf club head assembly according to claim 1, wherein the hosel, the a crown section, the toe section, the bottom section, the hollow interior, and the strike plate of the club head are made as a single piece.

15. The golf club head assembly according to claim 1, wherein the strike plate includes a plurality of score lines.

* * * * *